United States Patent [19]

Stewart, Jr.

[11] 4,186,899

[45] Feb. 5, 1980

[54] CONTROLLED BEAM PROJECTOR

[75] Inventor: George W. Stewart, Jr., Costa Mesa, Calif.

[73] Assignee: Ford Motor Company, Dearborn, Mich.

[21] Appl. No.: 859,616

[22] Filed: Dec. 12, 1977

[51] Int. Cl.[2] ..... F41G 9/00; F42B 15/02

[52] U.S. Cl. ..... 244/3.13

[58] Field of Search ..... 244/3.13, 3.16; 250/203 B

[56] References Cited

U.S. PATENT DOCUMENTS

| | | | |
|---|---|---|---|
| 3,028,807 | 4/1962 | Burton et al. | 244/3.13 |
| 3,398,918 | 8/1968 | Girault | 244/3.13 |
| 3,690,594 | 9/1972 | Menke | 244/3.13 |
| 3,782,667 | 1/1974 | Miller, Jr. et al. | 244/3.13 |
| 3,995,792 | 12/1976 | Otto et al. | 244/3.14 |
| 4,111,385 | 9/1978 | Allen | 244/3.16 |

*Primary Examiner*—Verlin R. Pendegrass

*Attorney, Agent, or Firm*—Paul K. Godwin, Jr.; Clifford L. Sadler

[57] ABSTRACT

A beam projector which is controlled to alternately transmit rectangular cross-sectional beams substantially parallel to a projection axis, wherein the beams are respectively pulse modulated over a correspondingly distinct pulse rate frequency range to supply yaw and pitch information and are respectively scanned in a direction correspondingly orthogonal to its cross-sectional length. The size format of the beam cross-sections and the angle of the scan are controlled according to a predetermined time variable function. In a first time period, the largest cross-sectional beams are alternately transmitted and the scan angle is decreased as a function of time, so that a fixed area of detectable information is available for detection with respect to an imaginary orthogonal reference plane moving along the projection axis at a rate corresponding to the predetermined time variable function. In subsequent time periods proportionately smaller cross-sectional beams are transmitted and the scan angle is continually controlled.

A first embodiment employs the use of a single set of proportionately different size formattec cross-sectional laser sources as a radiation generator, a scanning mechanism and a beam chopper fixed focus optical system to effect alternately transmitted beams, of selectable cross-section, orthogonally oriented and scanned with respect to each other.

A second embodiment employs two corresponding sets of proportionately different size formatted cross-sectional laser sources, a scanning mechanism and a non-chopping fixed focus optical system to effect alternately transmitted beams of selectable cross-section, orthogonally oriented and scanned with respect to each other.

12 Claims, 8 Drawing Figures

CONTROLLED BEAM PROJECTOR

BACKGROUND OF THE INVENTION

1. Field of the Invention

The present invention relates to the field of information transmission, and more specifically to an optical beam projector which supplies coordinate reference information to a remote receiver.

2. Description of the Prior Art

In a prior art reference issued to Girault (U.S. Pat. No. 3,398,918) two embodiments of optical systems are proposed for guiding projectiles. In the first embodiment, four fan-shaped beams are independently modulated and projected towards a target and thereby form four optical walls of a pyramidal corridor for guiding projectiles. The projectile traveling in this fashion tends to guide itself by bouncing around inside the corridor. The size of the downrange corridor is controlled by a servo driven zoom lens arrangement. In the second embodiment disclosed in the Girault reference, a proportional guidance system provides two perpendicularly oriented beams which sweep in directions perpendicular to each other in order to direct the projectile. In the second embodiment, the two beams are derived from a single light source and optically divided, respectively modulated and projected by a controlled zoom lens type system wherein the optical elements are variably oriented with respect to each other.

SUMMARY OF THE INVENTION

The present invention is directed to an improved electromagnetic radiation beam projector which eliminates the zoom lens system of the prior art and achieves more accurate control of the beam size projected in accordance with a time function. This projector is used, for instance, in a beam rider missile system, wherein the missile or projectile contains tail sensors which utilize the projected beam of radiation as a means of controlling its directional flight. By determining its relative location within the cross-section of a projected beam pattern, the missile responds by steering itself to seek the center of the beam pattern. In order to control the flight path of a missile having a known flight profile (distance from launch versus time), it is most desirable to project a matrix pattern so that the cross-sectional area of information is maintained constant over the known flight profile.

The projected scan pattern of the present invention is formed by two alternately scanned and orthogonally oriented beams of radiation which are pulse modulated over respective predetermined ranges of pulse rates to present a plurality of measurable pulse rates at predetermined relative coordinates or "bins" within the defined matrix.

A first beam, having a predetermined rectangular cross-sectional area, is projected so that its length dimension is horizontal to a reference and is vertically scanned over a predetermined angle. The first beam is pulse modulated at a predetermined number of rate values within a first predetermined range of rates during its vertical scan over the predetermined angle.

A second beam, having the same predetermined rectangular cross-sectional area as the first beam, is, in alternation with the first beam, oriented vertically with respect to the aforementioned reference and is scanned horizontally over the same predetermined angle to cover an area common to the vertically scanned area.

The second beam is also pulse modulated at a predetermined number of different rate values within a second predetermined range of rates within its horizontal scan over the predetermined angle.

As a result, a matrix information pattern is projected which has a number of detectable bins corresponding to a particular vertical scan pulse rate and a horizontal scan pulse rate. For example, where the scanned beams are each pulse modulated at 51 different frequencies, 2,601 bins are defined in the matrix. In addition, since the scan beams are each pulse modulated over separate ranges (e.g., 10.460–11.682 KHz for the vertical scan and 13.089–15.060 KHz for the horizontal scan), a discriminative receiver within the matrix can readily determine its position in that pattern.

It is an objective of the present invention to provide a compact, lightweight projector, which is both reliable and accurate. Two embodiments of the present invention have been developed and are presented hereinbelow, which achieve the desired objectives.

In the first embodiment, a single source of radiation is employed consisting of three selectively driven lasers which are individually coupled to corresponding fiber optic systems cross-sectionally formatted to deliver radiation in any of three separately selectable cross-sectional densities. In this single source of radiation, the lasers are individually and selectively driven so that only one is on at a time. Therefore, the output of the single source of radiation has a selectable cross-sectional density and is a key factor in eliminating the need for variable optical systems (zoom lenses) of the prior art.

Radiation, emitted from the single source, is fed to a scanning means such as a dither mirror which provides lateral scanning movement of the generally rectangular cross-sectional radiation over predetermined angles. The scanned radiation is then fed to a beam splitter optical projection system, wherein, in synchronization with the scanning dither mirror, the beam is split and projected as two beams which are alternately scanned in orthogonal directions and orthogonally oriented will respect to each other to provide respective yaw and pitch information.

In the second embodiment, two sources of radiation are employed which are each substantially the same as the single source described above. In the second embodiment, the mechanical beam splitter of the optical projection system is eliminated and the two sources are alternately modulated in synchronism with the scanning means mirror, to provide alternate yaw and pitch beam projection through a fixed optical system.

It is an object of the present invention to provide a compact and accurately controlled beam projector having a minimum number of mechanically movable parts.

It is another object of the present invention to provide a beam projector which transmits orthogonal beams of radiation having identical predetermined cross-sectional sizes utilizing a relatively fixed lens system.

It is a further object of the present invention to provide a controlled beam projector which projects a matrix of detectable pulse rate bins controlled in size to remain substantially constant with respect to a missile, having a known flight path, guided by said matrix of detectable information.

BRIEF DESCRIPTION OF THE DRAWINGS

FIG. 5 illustrates a second embodiment of the present invention, whereby two sets of corresponding laser elements for alternately generating rectangular cross-sectional beams, such as those shown in FIG. 3, are alternately selected and modulated to generate corresponding cross-sectional beams of radiation to a beam splitter and are then projected by a fixed lens system.

FIG. 6 is a block diagram illustrating an electrical control system for use in the first and second embodiments of the present invention.

DETAILED DESCRIPTION OF THE INVENTION

Figures 4A, 4B, 4C:
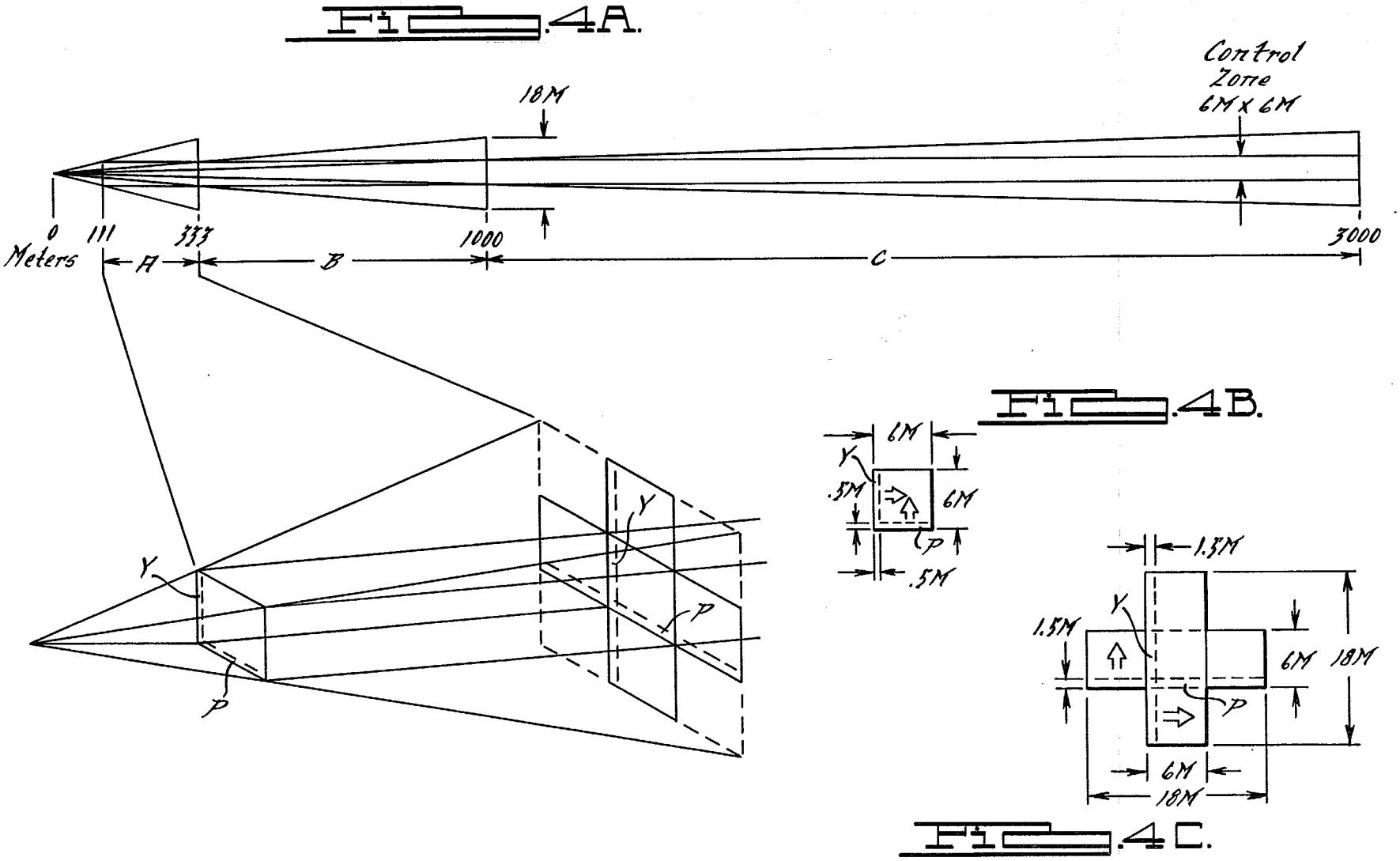
FIG. 4A is a schematic illustration of the various parameters considered in the projection of the controlled radiation pattern over a typical flight path of a missile.
FIG. 4B is a schematic illustration of the scanning pattern of the alternately projected beams of radiation at the low end of the range of the correspondingly selected light source.
FIG. 4C is a schematic representation of the light beam pattern at the extreme end of the radiation scan pattern for the selected radiation source.
Figure 8:
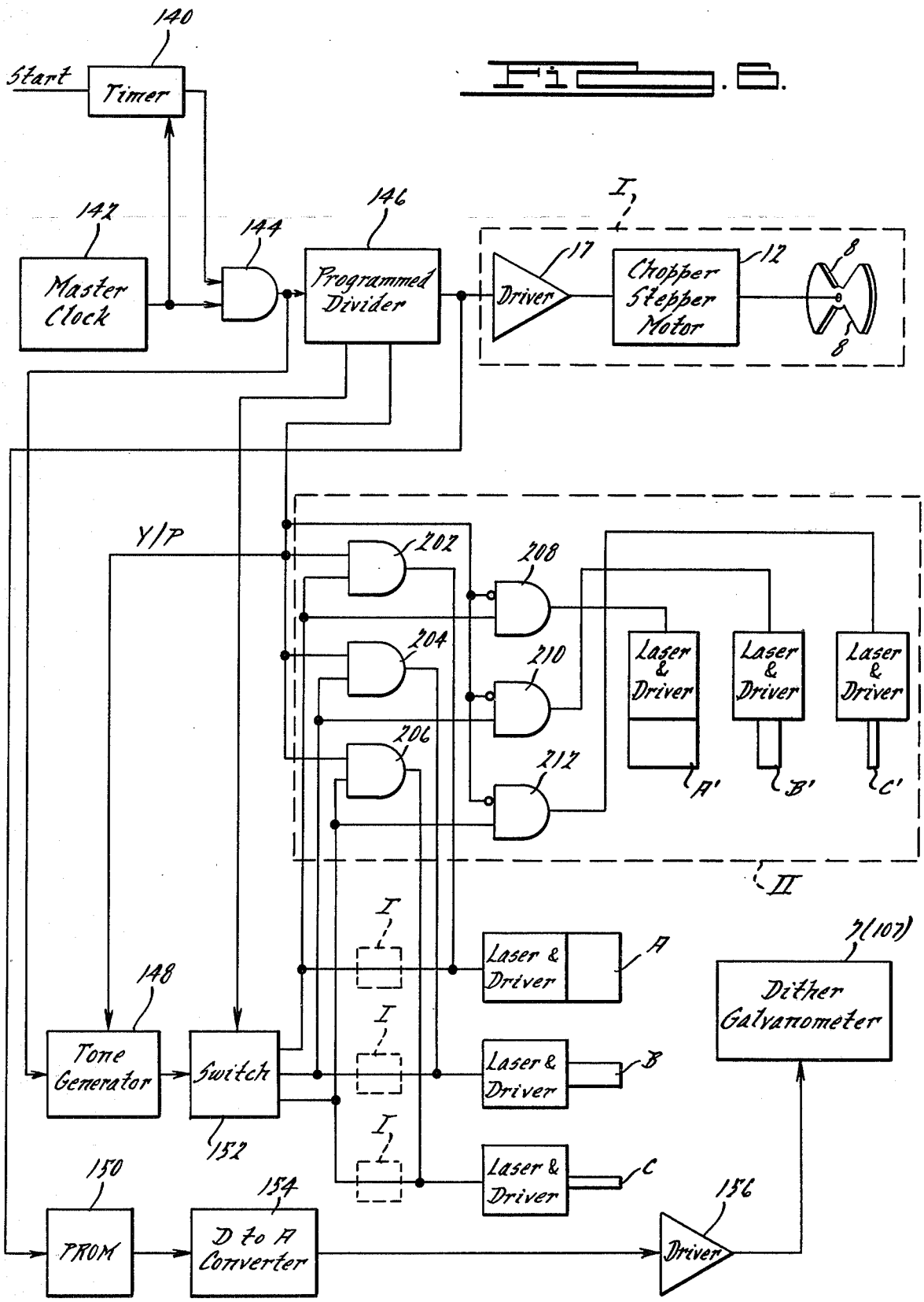

In FIGS. 4A, 4B, and 4C, a projected guidance pattern is illustrated over a hypothetical control range of approximately 3000 meters. The embodiments of the present invention are described herein with respect to the exemplified range of control. However, it should be understood that in each instance where specific measurements are given, in order to illustrate particular design parameters, such measurements are not restrictive of the scope of the present invention.

Figure 1:
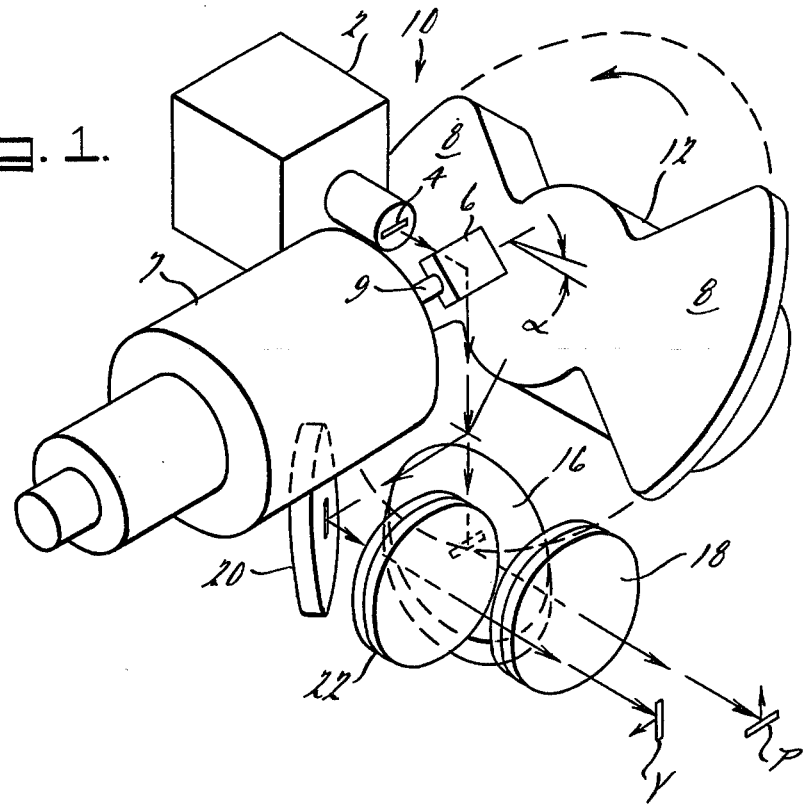
FIG. 1 illustrates a first embodiment of the subject invention utilizing a single source of radiation and a beam chopper in a relatively fixed lens system for effecting alternate transmission of two orthogonally oriented beams.

A first embodiment of the present invention is shown in FIG. 1, wherein pitch (P) and yaw (Y) information beams of radiation are alternately projected from a single source 2. The source 2 comprises three Ga-As lasers, which are optically interfaced to clad glass rectangular fibers in an assembly format 3 (shown in FIG. 2). The clad glass fiber assembly 3 has three separate rectangular channels for conducting radiation from a correspondingly associated laser generator. Each rectangular channel, A, B and C, has a proportionately different cross-sectional size and transmits a rectangular cross-section beam 4 in accordance with the particular individual laser which is selectively driven. In this embodiment, only one laser is driven at a time, in order to select the desired cross-section size beam for transmission.

A dither mirror 6, mounted on a shaft 9, interrupts the beam 4 transmitted from the source 2 and reflectively scans the beam over a predetermined angle $\alpha$ in a direction orthogonal to the length dimension of the rectangular cross-section of the beam 4. The shaft 9 is rotated for sinusoidal oscillatory motion through the predetermined angle $\alpha$ about an axis, which interrupts the path of beam 4, by a controlled galvanometer 7.

A rotating optical chopper 12, having a plurality of reflective surfaces 8 and an equal number of transparent areas distributed therearound, is oriented to interrupt the transmitted beam 4 after it is scanned by the dither mirror 6, to effect rotation and derotation of the beam. When the reflective surface 8 interrupts the rectangular cross-section beam 4, the beam is rotated and reflected by the reflective surface 8 to a mirror 20. The mirror 20 reflects the beam through a projection lens 22 as a Y information beam rotated 90° in orientation with respect to the transmitted beam 4. When the reflective surface 8 moves to a non-interrupting position revealing a transparent area of the chopper 12, the scanned beam is transmitted directly from the dither mirror 6 to a mirror 16. The mirror 16 is oriented so as to reflect the beam towards a projection lens 18 with substantially the same relative horizontal orientation as beam 4. This horizontally oriented beam is projected by projection lens 18 as a P information beam oriented 90° with respect to the Y beam.

Figure 3:
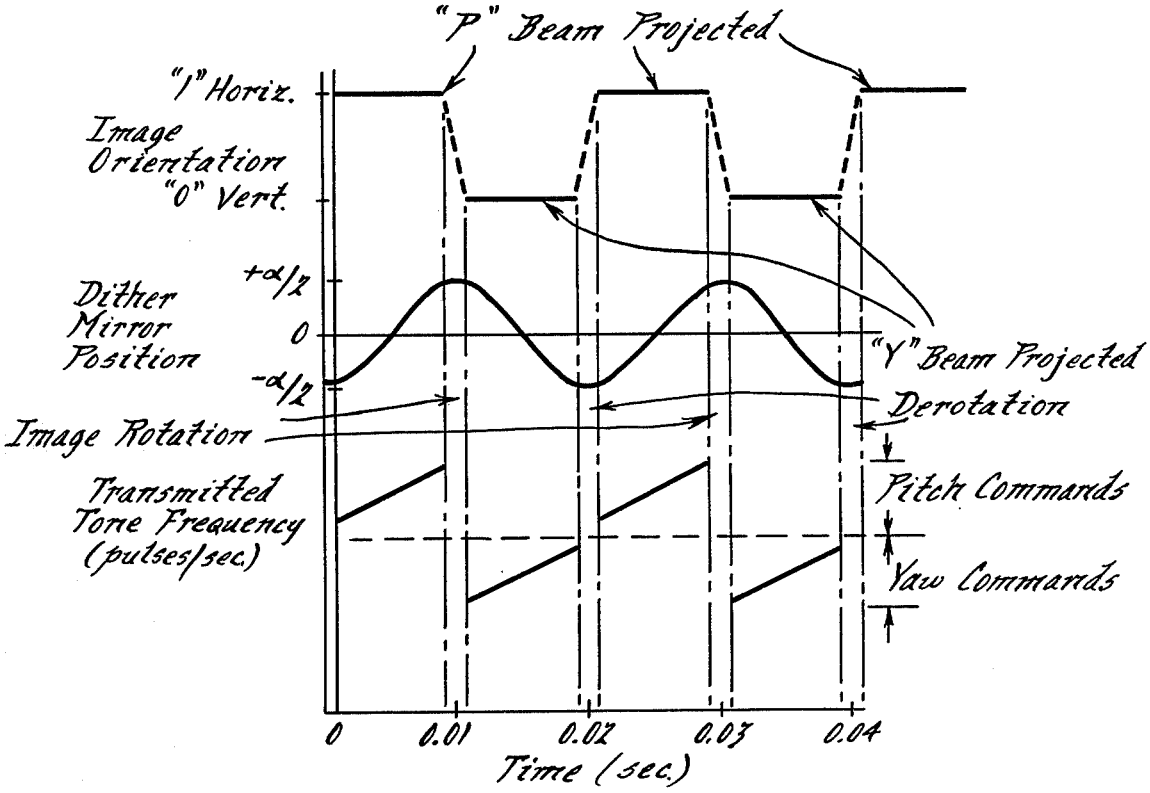
FIG. 3 illustrates various control operations occuring over a period of time.
Figure 3:
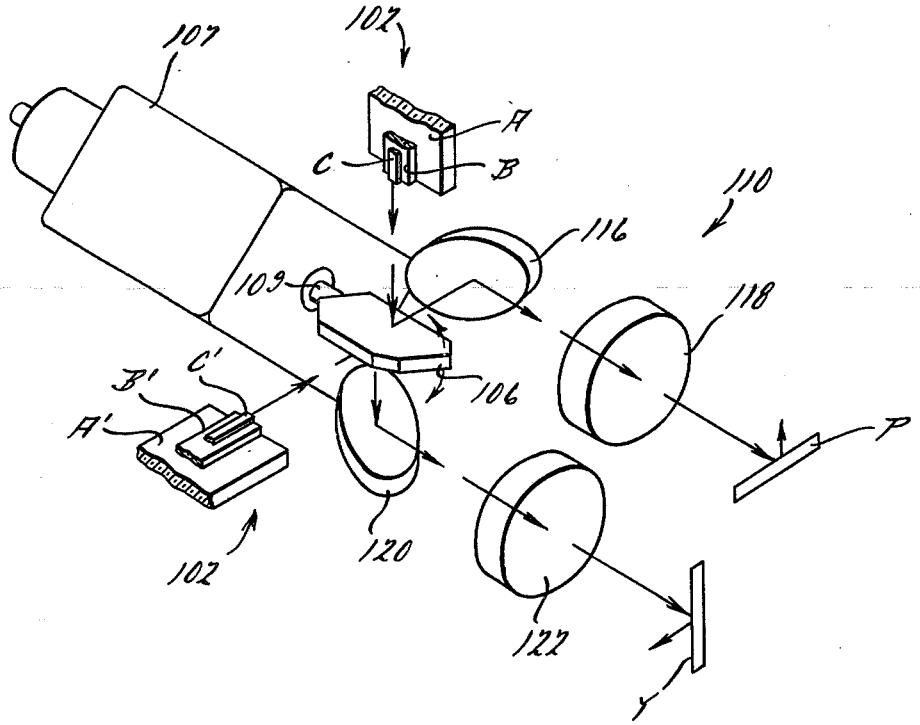

Operation of the embodiment in FIG. 1 is explained by referring to FIG. 3. A single laser in source 2 is synchronously tone modulated to transmit a beam 4 which is generally horizontal with respect to a reference plane. At the beginning of the time cycle, the dither mirror 6 is at an extreme point of the predetermined scanned angle $\alpha$ and commences its rotational motion through that angle. For the 50 Hz time cycles in FIG. 3, the P beam is shown as being projected first. Therefore, during the first half cycle of the oscillatory rotation of the dither mirror 6, through the predetermined angle $\alpha$, the reflective surfaces 8 of the chopper 12 do not interrupt the beam 4. In synchronism, the dither mirror 6 is rotated, the selected laser of source 2 is pulse modulated over a first range of frequencies, and the chopper 12 is rotated. Therefore, a P beam having a relatively horizontally oriented cross-section is projected, and scanned in a relatively vertical direction.

When the dither mirror 6 reaches the limit of its first half cycle of angular rotation, a period of image rotation is provided, of approximately 2.5 ms, wherein the selected laser is not modulated and the reflective surface 8 rotates into a beam interrupting position. In synchronism, the dither mirror 6 begins its rotation in its second half cycle of oscillatory rotation through the predetermined angle $\alpha$. During that second half cycle, the selected laser is pulse modulated over a second range of frequencies, and the reflective surface 8 continues to interrupt and reflect the scanned beam through the mirror 20 and projection lens 22. Therefore, the Y beam is projected having a relatively vertically oriented cross-section and is scanned in a relatively horizontal direction.

The present invention has particular application in missile guidance systems, wherein the missile has a receiver with appropriate demodulation and logic electronics on board so as to enable the missile to respond to information received from the radiated beams. By identifying the two received pulse frequencies for the respectively received P and Y beams, the receiver will be able to determine the missile location within the projected pattern and command certain steering corrections to the missile. In FIGS. 4A, 4B and 4C, the projected information pattern is conceptually illustrated as an aid in describing the desired objectives obtained by the present invention.

FIG. 4A illustrates a hypothetical flight range of 3000 meters for a hypothetical missile which is to be guided by this system. Guidance is programmed to begin when the missile is 111 meters down-range from the beam projector of the present invention. The system also requires, in this embodiment, that the missile move away from the beam projector along the line-of-sight path connecting the beam projector and the missile. Guidance of the missile continues as long as the missile receives guidance information. In this case, 3000 meters is the known maximum range of the missile, and therefore, the maximum range necessary for effective control of the projected information pattern.

Figure 2:
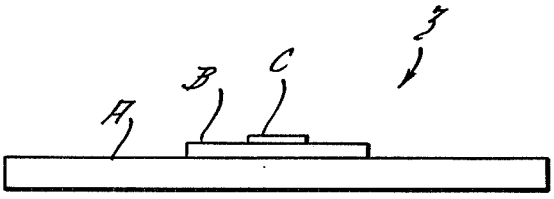
FIG. 2 illustrates the proportionately differing cross-sections of the radiation which are selectively transmitted by the radiation generating means shown in FIG. 1.

During the time the missile is predicted to be in the range from 111 meters to 1000 meters, the laser associated with the clad glass rectangular fiber A, shown in FIG. 2, is selected for pulse modulation. Since, in this example, the rectangular fiber A has cross-sectional dimensions of 2.76 mm by 0.23 mm and an aspect ratio of 12:1, the resultant projected P beam cross-section measures 6 meters wide and 0.5 meters high at a range of 111 meters. When the P beam is at its lowest point of vertical scan at 111 meters it appears at 3 meters below the optical axis of the projector. The P beam scans upward (see FIG. 4B) for 7.5 ms over a distance of 6 meters and then disappears. During this upward scan of the P beam, it is modulated over the first range at 51 different pulse rates in order to define 51 detectable levels within the projected pattern.

Approximately 2.5 ms after the P beam disappears, the Y beam is projected having the same dimensions as the P beam. As referenced by looking from the projector, the Y beam appears 3 meters to the left of the optical axis at 111 meters down-range and is scanned 6 meters in the right direction over the next 7.5 ms. During that scan period of 7.5 ms, the Y beam is pulse modulated at 51 different pulse rates in the second range, which is different than the first range of pulse rates for P beam modulation. Therefore, the combination of P and Y beams being swept across a common overlapping area in space defines 2601 separate bins of detectable information in a 51×51 matrix format, wherein the center bin corresponds to the optical axis of the projector.

It is most important to control the size of the scan pattern over the flight of the missile in order to communicate the same relative location information to the missile regardless of its down-range position. For example, if the missile is 3 meters to the left and 1 meter below the optic axis, when it is 111 meters down-range, it receives yaw and pitch information corresponding to the particular bin located 3 meters to the left and 1 meters below the optic axis bin. Therefore, since the objective is to provide a constant sized area of information with respect to the flight path profile, the missile will receive the same bin of yaw and pitch information indicated above at any down-range location where the missile is 3 meters to the left and 1 meter below the optic axis. Of course, the same holds true for all the other information bins located within the projected pattern of information.

The present invention maintains a constant sized area of information with respect to the predicted flight path function of down-range distance versus time, by varying the dither mirror scan angle $\alpha$ over a predetermined down-range distance d(t). Therefore, during the time the missile is predicted to be moving down-range, the dither mirror A6 is scanned over angle $\alpha = \text{Arctan}\ h/d(t)$, where h represents the maintained square scan pattern height (and width) of 6 meters. By the time the missile reaches 333 meters, the projected beams have diverged to have a length dimension of 18 meters and a width dimension of 1.5 meters. However, the overlapping area of scan is maintained at 6×6 meters, as is shown in FIG. 4C, by controlling the dither mirror scan angle $\alpha$. Since the beam width derived from the fiber A is so large at 333 meters, the laser associated with fiber A is turned off and the laser behind fiber B is turned on.

The cross-sectional size of the fiber B is 0.914 mm×0.076 mm, and also has an aspect ratio of 12:1. Therefore, the Y and P beam reactangular cross-sections derived from fiber B at 333 meters are 6 meters×0.5 meters, as shown in FIG. 4B, and are scanned over the continually decreasing angle $\alpha$ until the missile distance is predicted to be at 1000 meters. At that point, the Y and P beam cross-sections are the size indicated in FIG. 4C with a 6×6 meter scan pattern size.

At 1000 meters, the laser behind fiber B is turned off, the laser behind fiber C is turned on and is appropriately modulated. The fiber C has dimensions of 0.305 mm×0.025 mm and also have an aspect ratio of 12:1. At 1000 meters, the Y and P projected beams from the C fiber have dimensions of 6 meters×0.5 meters as shown in FIG. 4B. The beam cross-sections continue to diverge and at 3000 meters they reach dimensions as shown in FIG. 4C.

The second embodiment of the present invention is shown in FIG. 5, wherein elements common to the first embodiment are indicated with the same numerals plus 100. For example, mirror 20 in FIG. 1 is shown as mirror 120 in FIG. 5.

The embodiment shown in FIG. 5 eliminates the chopper element of the optical system shown in the first embodiment by substituting a pair of laser sets and associated fibers of each size to be alternately driven and modulated. The source 102 comprises a first set of lasers individually associated with one of the fibers A, B and C, which are formatted as in FIG. 2, for radiating a selected cross-section sized beam towards a first reflective surface of dither mirror 106. The source 102 also comprises a second set of lasers individually associated with one of the fibers A', B' and C', which are also formatted as in FIG. 2, for radiating a correspondingly selected cross-section sized beam towards a second reflective surface of the dither mirror 106. In this embodiment, the dither mirror 106 is connected to a shaft 109 and is rotationally driven for sinusoidal oscillatory motion about an angle $\alpha$ by the galvanometer 107. Therefore, by selectively modulating a single laser in the first set (e.g., A) when the dither mirror 106 is rotated in a first direction and selectively modulating a corresponding single laser in the second set (e.g., A') when the dither mirror 106 is rotated in the second direction, two separately oriented and scanned beams are transmitted.

A mirror 120 is oriented to receive the scanned beam radiated from the first set of fibers and a mirror 116 is oriented to receive and reflect the scanned beam radiated from the second set of fibers. The scanned beam reflected from the mirror 116 is projected by lens 118 as the P beam and that reflected by mirror 120 is projected by lens 122 as the Y beam.

Each of the two embodiments described above are similarly controlled to project the correctly sized beam over a correct scan angle by circuitry shown in FIG. 6. In FIG. 6, elements designated as "I" are unique to the first embodiment and those designated as "II" are unique to the second embodiment.

A master clock 142 generates a train of high frequency pulses to provide accurate timing for the various programmed functions. The output of the master clock 142 is fed to a timercounter 140 which is preset for the particular missile flight path profile so that after a missile fire "start" signal is received, the timer will output an enabling signal to AND gate 144 after a sufficient amount of time has passed which predicts that the missile is at 111 meters down-range. At that point, AND gate 144 is enabled to gate pulses from the master clock 142. Gated signals from the AND gate 144 are fed to a programmed divider 146 and to a tone generator 148. The programmed divider 146 is configured to output command signals at predetermined times along the known flight path in order to effect synchronization of proper laser selection, laser modulation and dither mirror control. An output of the programmed divider 146 is fed to a PROM 150 which functions as a sine wave look-up table and provides a digital output in response to the count input address. The output of the PROM 150 is fed to a D to A converter 154 where the digital values are converted to a controlled amplitude 50 Hz analogue sine wave. The analogue sine wave is amplified by driver 156 and controls the movement of the dither mirror through dither galvanometer 7 (107).

The programmed divider 146 also supplies a yaw/-pitch beam signal to a tone generator 148 which provides 51 steps of pulse rates to a selected laser/driver over separate ranges for each respective yaw or pitch beam transmission. An electronic switch 152 is controlled by the output of the program divider to select the desired laser/driver size format which receives the tone generator output.

In the first embodiment I, a driver 17 is connected to receive the output from the programmed divider 146 which, in turn, drives a chopper stepper motor 12 to cause synchronous rotation of the reflective surfaces 8. In addition, the output from the tone generator 148 is connected through switch 152 directly to a selected laser/driver behind its corresponding fiber A, B, or C.

In the second embodiment II, where the three additional laser/drivers and associated fiber format are provided to replace the beam chopper, the three output lines from the switch 152 are correspondingly connected to the first input terminal of pairs of AND gates 202 and 208; 204 and 210; 206 and 212. The yaw/pitch control signal from the programmed divider 146 is commonly connected to the second input terminal of AND gates 202, 204, and 206 and is also connected to an inverted input terminal on each of AND gates 208, 210, and 212. As indicated in FIG. 2, where a "1" dictates that the P beam will be projected, AND gates 202, 204, and 206 are enabled by a P="1" latch signal from the program divider 146. According to the output of switch 152, the tone modulation of tone generator 148 will be gated through the appropriate AND gate 202, 204, or 206 to one of the corresponding laser/driver elements behind the selected one of the formatted fibers A, B, or C.

When the Y beam is to be transmitted by the second embodiment II, the latched "O" signal from the program divider 146 enables AND gates 208, 210 and 212 and provides for selective modulation of one of the laser/drivers behind the formatted fibers A', B', or C'.

It will be noted that the main advantages, contributed by the present invention described with respect to each of the above embodiments, are the achievement of maintaining a matrix of guidance control information having fixed dimensions over the programmed range of a missile by employing stepwise switching of the beam format size being projected at preselected range points through a fixed focal length optical system; combined with scanning the projected beams in a programmed manner wherein the scan amplitude is a function of the predicted range of the missile. It will, therefore, be apparent that many modifications and variations may be effected without departing from the scope of the novel concepts of this invention. Therefore, it is intended by the appended claims to cover all such modifications and variations which fall within the true spirit and scope of the invention.

I claim:

1. A controlled beam projector for alternately generating two orthogonally oriented and orthogonally scanned rectangular cross-section beams of radiation, comprising:

means for selectively generating a plurality or orthogonally oriented beams of radiation;

means for selectively energizing said generating means to alternately generate orthogonally oriented beams of radiation having a corresponding predetermined cross-sectional area;

means connected to said energizing means for modulating respective alternately generated beams at pulse rates which vary over respectively non-overlapping predetermined ranges of pulse rate frequency;

means located in the path of said modulated beams for scanning each beam over controlled angles orthogonal with respect to its cross-sectional length dimension;

means in the path of said scanned beams for optically projecting said scanned beams substantially parallel to a central projection axis; and means connected to said scanning means for controlling the angle of each said orthogonal scan according to a time variable function.

2. A controlled beam projector as in claim 1, wherein said radiation generating means comprises a plurality of radiation generators mounted to emit beams of radiation having proportionally different cross-sectional length and width dimensions, and said controlling means selects an individual one, of said plurality of radiation generators for energization by said energization means and for modulation by said modulating means, in accordance with said time variable function.

3. A controlled beam projector as in claim 1, wherein said radiation generating means comprises first and second sets of radiation generators which are alternately selectable to emit respective first and second pulse modulated radiation beams to said scanning means.

4. A controlled beam projector as in claim 3, wherein said controlling means alternately selects corresponding radiation generators in said first and second sets for energization by said energizing means and for modulation by said modulating means.

5. A controlled beam projector as in claim 1, wherein said projecting means comprises a fixed lens optical system.

6. A controlled beam projector as in claim 1, wherein said generating means includes a plurality of laser sources which respectively radiate monochromatic electromagnetic radiation.

7. A controlled beam projector comprising:

means for selectively generating a beam of radiation having a generally rectangular cross-sectional area;

means for receiving said beam of radiation and for scanning said beam over at least one predetermined path orthogonal to the length of said beam cross-section;

means in the path of said scanned beam for optically projecting said beam as two alternately scanned beams having said cross-sectional length dimensions orthogonally oriented with respect to each other, wherein said generating means includes at least one set of lasers, each laser of said at least one set being selectable to generate a beam of energy and further wherein each selected beam has a different cross-sectional area.

8. A controlled beam projector as in claim 7, wherein said projector further includes means for selecting one of said lasers to generate said beam;

means for generating a time variable function and an output control signal indicative thereof; and means receiving said control signal for pulse modulating said selected laser at a plurality of repetition rates in accordance with said time variable function over a predetermined range of repetition rates.

9. A controlled beam projector as in claim 8, wherein said scanning means includes a mirror oscillating about an axis transverse to said beam emitted from said generating means;

said projector further includes means receiving said control signal for responsively oscillating said mirror about an angle value which is predetermined in accordance with said time variable function; and said selecting means receives said control signal and selects one of said lasers in accordance with said time variable function.

10. A controlled beam projector as in claim 7, wherein said generating means includes two sets of lasers and each set of lasers includes a plurality of lasers each being selectable to emit radiation having a proportionately different cross-sectional area corresponding to the other set.

11. A controlled beam projector as in claim 10, wherein said scanning means is a planar mirror having two opposite facing coplanar reflective surfaces mounted to oscillate about preselected angles on an axis transverse to the radiation from said generating means.

12. A controlled beam projector as in claim 11, wherein said projector includes means for generating a time variable function and an output control signal indicative thereof; and means receiving said control signal for alternately selecting predetermined onces of corresponding lasers in each set.

* * * * *

UNITED STATES PATENT AND TRADEMARK OFFICE

CERTIFICATE OF CORRECTION

PATENT NO. : 4,186,899

DATED : February 5, 1980

INVENTOR(S) : George W. Stewart, Jr.

It is certified that error appears in the above-identified patent and that said Letters Patent are hereby corrected as shown below:

Assignee designation cancel "Ford Motor Company" and substitute --Ford Aerospace and Communications Corporation.--

Column 2, line 44, cancel "will" and substitute --with--.

Column 6, line 21, cancel "have" and substitute --has--.

Column 8, line 19, cancel "or" and substitute --of--.

Column 10, line 25, cancel "onces" and substitute --ones--.

Signed and Sealed this

*Third* Day of *June 1980*

[SEAL]

*Attest:*

SIDNEY A. DIAMOND

*Attesting Officer*

*Commissioner of Patents and Trademarks*